United States Patent [19]

Waynick

[11] Patent Number: 4,986,923

[45] Date of Patent: Jan. 22, 1991

[54] FRONT-WHEEL DRIVE GREASE WITH SYNERGISTIC SULFATE AND CARBONATE ADDITIVE SYSTEM

[75] Inventor: John A. Waynick, Bolingbrook, Ill.

[73] Assignee: Amoco Corporation, Chicago, Ill.

[21] Appl. No.: 371,913

[22] Filed: Jun. 27, 1989

[51] Int. Cl.[5] ..... C10M 125/10; C10M 125/22

[52] U.S. Cl. ..... 252/25; 252/49.6; 252/51.5 R

[58] Field of Search ..... 252/25, 51.5 R, 49.6

[56] References Cited

U.S. PATENT DOCUMENTS 4,168,241 9/1979 Kozima ..... 252/25

4,830,767 5/1989 Wagnick ..... 252/25

*Primary Examiner*—Jacqueline V. Howard

*Attorney, Agent, or Firm*—Thomas W. Tolpin; William H. Magidson; Ralph C. Medhurst

[57] ABSTRACT

A high performance sulfated lubricating grease effectively lubricates front-wheel drive joints as well as other equipment. The lubricating grease has excellent extreme pressure properties and antiwear qualities and is economical, effective, and safe. In one preferred form, the sulfated lubricating grease comprises a base oil, a polyurea thickener, a borated oil-separation inhibitor, and a special synergistic, additive package comprising calcium sulfate and calcium carbonate.

21 Claims, 2 Drawing Sheets

FRONT-WHEEL DRIVE GREASE WITH SYNERGISTIC SULFATE AND CARBONATE ADDITIVE SYSTEM

BACKGROUND OF THE INVENTION

This invention pertains to lubricants and, more particularly, to a lubricating grease which is particularly useful for drive joints of front-wheel drive vehicles.

In front-wheel drive automobiles, vans, and trucks, the front wheels are driven by the engine via a front axle assembly and a number of front-wheel drive joints. These front-wheel drive joints facilitate movement of the front axle assembly while maintaining constant rotational velocity between the front wheels. The front-wheel drive joint is often referred to as a constant velocity (CV) joint. The outer CV joint usually has a boot comprising an elastomer, such as polyester or neoprene, and an inner joint comprising a higher temperature-resistant elastomer, such as silicon-based elastomers.

Front-wheel drive joints experience extreme pressures, torques, and loads during use. Operating temperatures can vary from −40° F. during winter to over 300° F. during summer.

Front-wheel drive greases are required to provide wear resistance. When a front-wheel drive vehicle is driven, sliding, rotational, and oscillatory (fretting) motions simultaneously occur within the front wheel drive joint, along with large loads and torques. A grease which minimizes wear from one of these motions or conditions will not necessarily protect against the others.

With the newer designs of many automobiles, trucks, vans, and other mobile equipment, the extreme pressure and wear resistance requirements of the front-wheel drive grease have steadily increased. Previous additive technologies which give levels of performance typified by prior art greases may no longer be satisfactory for truly outstanding performance. Higher levels of performance are desired.

Front-wheel drive greases are also required to be chemically compatible with the elastomers and seals in front-wheel drive joints. Such greases should not chemically corrode, deform, or degrade the elastomers and seals which could cause swelling, hardening, loss of tensile strength, and ultimately rupture, oil leakage, and mechanical failure of the CV joints and seals.

Another requirement of front-wheel drive greases is that the grease and all its components be inert, non-reactive, and non-corrosive to ferrous and non-ferrous metals even when prolonged contact occurs at high temperatures. The importance of this is readily apparent in applications such as front-wheel drive joint lubrication where temperatures in excess of 300° F. can occur and the grease must perform for the entire life of the joint. If the lubricant or any component therein becomes corrosive to the steel parts, such corrosion will result in accelerated wear and ultimate failure of the joint. Similarly, if any component of the grease reacts with water to form corrosive compounds, similar premature joint failure will result. This later effect can be particularly troublesome since small amounts of moisture will usually be present in the joint due to the ambient humidity of the air.

Another requirement of front-wheel drive greases is that they should be toxicologically safe. During the assembly line filling of CV joints with front-wheel drive grease, workers can be be exposed to the lubricant.

Also, the front-wheel drive grease used by CV joint manufacturers is also often used in CV joint repair kits which are sold in various automotive parts retail stores. These kits are sold to members of the general public who wish to repair or replace a CV joint or CV joint boot on their car. The grease in such kits is generally stored in a plastic pouch. Persons using such kits will invariably come in contact with the grease during the act of opening the pouch and applying the grease to the CV joint. Therefore, front-wheel drive grease should contain no materials which are severe skin irritants. Moreover, front-wheel drive grease should contain no materials which are carcinogenic or mutagenic. Neither should front wheel drive greases contain materials which are members of the same chemical family of similar materials which have been shown to be carcinogenic or mutagenic.

Over the years, a variety of greases have been suggested for use with front-wheel drive joints and/or other mechanisms. Typifying such greases are those found in U.S. Pat. Nos. 2,964,475, 2,967,151, 3,259,573, 3,344,065, 3,843,528, 3,846,314, 3,920,571, 4,107,058, 4,305,831, 4,431,552, 4,440,658, 4,514,312, 4,759,859; 4,787,992; 4,830,767; and Re. 31,611. These greases have met with varying degrees of success.

In particular, U.S. Pat. No. 3,259,573 does not provide the higher level of performance required in todays more highly loaded constant velocity (CV) joints and other similarly loaded parts.

U.S. Pat. Nos. 4,107,058 , 4,305,831 , and 4,431,552 do not provide compositions with non-corrosivity to elastomers ferrous metals and non-ferrous metals at prolonged high temperatures due to their required inclusion of organo-sulfur materials.

Re 31,611 requires the use of materials which are very corrosive to ferrous and non-ferrous metals at high temperatures. Furthermore, this corrosive action dramatically accelerates the rusting of ferrous metals if even very low levels of moisture are present. Also, these materials are members of a family of compounds which have been found to exhibit carcinogenic characteristics, be of limited solubility in mineral oil, or both.

It is, therefore, desirable to provide an improved front-wheel drive grease which overcomes most, if not all, of the above problems.

SUMMARY OF THE INVENTION

An improved lubricating grease is provided which is particularly useful for front-wheel drive joints. The novel grease displayed unexpectedly surprisingly good results over many prior art greases. The new grease provides superior wear protection from sliding, rotational, and oscillatory (fretting) motions in front-wheel drive joints. It is also chemically compatible with elastomers and seals in front-wheel drive joints. It further resists chemical corrosion, deformation, and degradation of the elastomers and extends the useful life of CV (constant velocity) drive joints.

The novel grease performs well at high temperatures and over long periods of time. It exhibits excellent stability, superior fretting wear qualities, and outstanding oil separation properties even at high temperatures.

It is also remarkably non-reactive, non-corrosive, and chemically passive towards ferrous and even non-ferrous metals such as copper at prolonged high temperatures as high as 300° F. or even 350° F. This property is important in extending the useful life of CV-joints which can operate at such temperatures.

Advantageously, the grease is economical to manufacture, toxicologically safe, and can be produced in large quantities.

To this end, the improved lubricating grease has: (a) a substantial proportion of a base oil, (b) a thickener, such as polyurea, triurea, or biurea, (c) a sufficient amount of an additive package to impart extreme pressure properties to the grease. The improved lubricating grease may in addition have (d) a sufficient amount of a borated additive to impart further improved oil separation properties to the grease.

In one form, the additive package comprises sulfates and carbonates together, in the absence of halogenated materials. The sulfates are of a Group 2a alkaline earth metal, such as beryllium, magnesium, calcium, strontium, and barium, or a Group 1a alkali metal, such as lithium, sodium, and potassium. The carbonates are of a Group 2a alkaline earth metal or of a Group 1a alkali metal such as those described above. Calcium sulfate and calcium carbonate are preferred for best results and because they are economical, stable, nontoxic, essentially water insoluble, and safe.

Anhydrous calcium sulfate is most preferred over the various hydrated forms of calcium sulfate since waters of hydration should be avoided in the final grease. However, if the grease is processed at such temperatures and pressures so as to remove any water of hydration from the grease, then hydrated forms of calcium sulfate can be used without adverse effects in the final grease.

Calcium sulfate and calcium carbonate provide many unexpected surprisingly good advantages over calcium bisulfate and and calcium bicarbonate. For example, calcium sulfate is essentially water insoluble and will not be extracted from the grease if contacted with water. Calcium sulfate is also very compatible with the elastomers and seals in front-wheel drive joints. Similarly, calcium carbonate is extremely water insoluble and will not be extracted from the grease if contacted with water. Calcium carbonate is also very compatible with the elastomers and seals in front-wheel drive joints.

On the other hand, calcium bisulfate and calcium bicarbonate are water soluble. When water comes into significant contact with calcium bisulfate or calcium bicarbonate, they have a tendency to leach, run, extract, and washout of the grease. This destroys any significant antiwear and extreme pressure qualities of the grease. Calcium bisulfate and calcium bicarbonate are also protonated and have acidic hydrogen present which can adversely react, crack, degrade, and corrode seals and elastomers.

The use of both sulfates and carbonates in the additive packages produced unexpected surprisingly good results over the use of much greater amounts of either sulfates or carbonates alone. For example, the use of both sulfates and carbonates produced superior wear protection in comparison to a similar grease with a much greater amount of carbonates in the absence of sulfates, or a similar grease with a much greater amount of sulfates in the absence of carbonates.

Halogenated materials should be avoided when using the additive mixture comprising sulfates and carbonates. Halogenated materials to be avoided include halogenated hydrocarbons, particularly chlorinated paraffins. Such materials exhibit corrosive tendencies at prolonged high temperatures and thereby result in chemical attack to ferrous and non-ferrous metals. This corrosivity is greatly accelerated when water is present. Even small levels of water such as the moisture levels commonly found in air at room temperature are enough to cause catastrophic ferrous corrosion. Furthermore, the extremely large synergistic improvement in extreme pressure and antiwear properties produced by the sulfate/carbonate mixture is decreased when chlorinated paraffins are also present. Also, the National Toxicology Program (NTP) has evaluated some chlorinated paraffins and found them to exhibit clear evidence of carcinogenicity.

The combination of the above sulfates and carbonates also demonstrated a remarkable ability to lower the frictional heat generated during high speed, heavy loaded motion. This effect was much greater than that demonstrated by traditional extreme pressure/antiwear additive systems.

Furthermore, the combination of the above sulfates and carbonates achieved unexpected surprisingly good results in copper corrosion protection, even at 300° F. or 350° F., while also achieving compatibility with elastomers commonly used in front-wheel drive applications. This is in marked contrast to greases with other sulfur-containing materials such as insoluble arylene sulfide polymers which caused abrasion, corroded copper, degraded elastomers and seals, and significantly weakened their tensile strength and elastomeric qualities. Insoluble arylene sulfide polymers are also very expensive, making their use in lubricants prohibitively costly.

The non-corrosivity of the mixture of calcium sulfate and calcium carbonate at very high temperatures is also in marked contrast to oil-soluble sulfur-containing materials. Oil-soluble sulfur-containing materials are, at high temperature, very corrosive to both ferrous and non-ferrous metals. This corrosivity makes such materials unacceptable in applications where the lubricant is to provide sealed-for-life lubrication to the part for years of service. The use of oil-soluble sulfur-containing compounds should also generally be avoided in the additive package of front-wheel drive greases because they are chemically very corrosive and detrimental to the elastomers generally used. Oil-soluble sulfur compounds often destroy, degrade, or otherwise damage constant velocity joint boot elastomers and seals by adversely affecting their tensile strength and elasticity. Of course, when used in other applications where elastomer compatibility at high temperatures and long life without relubrication are not concerns, the addition of oil soluble and oil-insoluble sulfur-containing additives can be utilized in a manner well established and well known to those practiced in the grease-makers art.

In another form, the additive package comprises sulfates and carbonates with a minor amount of hydroxides. The preferred hydroxide is calcium hydroxide. The addition of calcium hydroxide to the sulfate and carbonate mixture imparts improved wear resistance to the grease and also provides additional overbasing to neutralize acidic materials which form over long periods of time as the grease oxidizes.

The use of borate additives and boron-containing inhibitors produced unexpected, surprisingly good results by decreasing and minimizing oil separation over a wide range of temperatures without imparting a tacky or stringy texture to the grease. Such borate additives include: borated amines, potassium triborate, borates of Group 1a alkali metals, borates of Group 2a alkaline earth metals, stable borates of transition metals such as zinc, copper, and tin, and boric oxide.

While the novel lubricating grease is particularly useful for front-wheel drive joints, it can also be advantageously used in universal joints and in bearings which are subjected to heavy shock loads, fretting, and oscillating motions. It can further be used as a railroad track lubricant on the sides of a railroad track. It can further be used in greases used to lubricate sealed-for-life automotive wheel bearings.

A more detailed explanation of the invention is provided in the following description and appended claims.

DESCRIPTION OF THE PREFERRED EMBODIMENT

Figure 1:
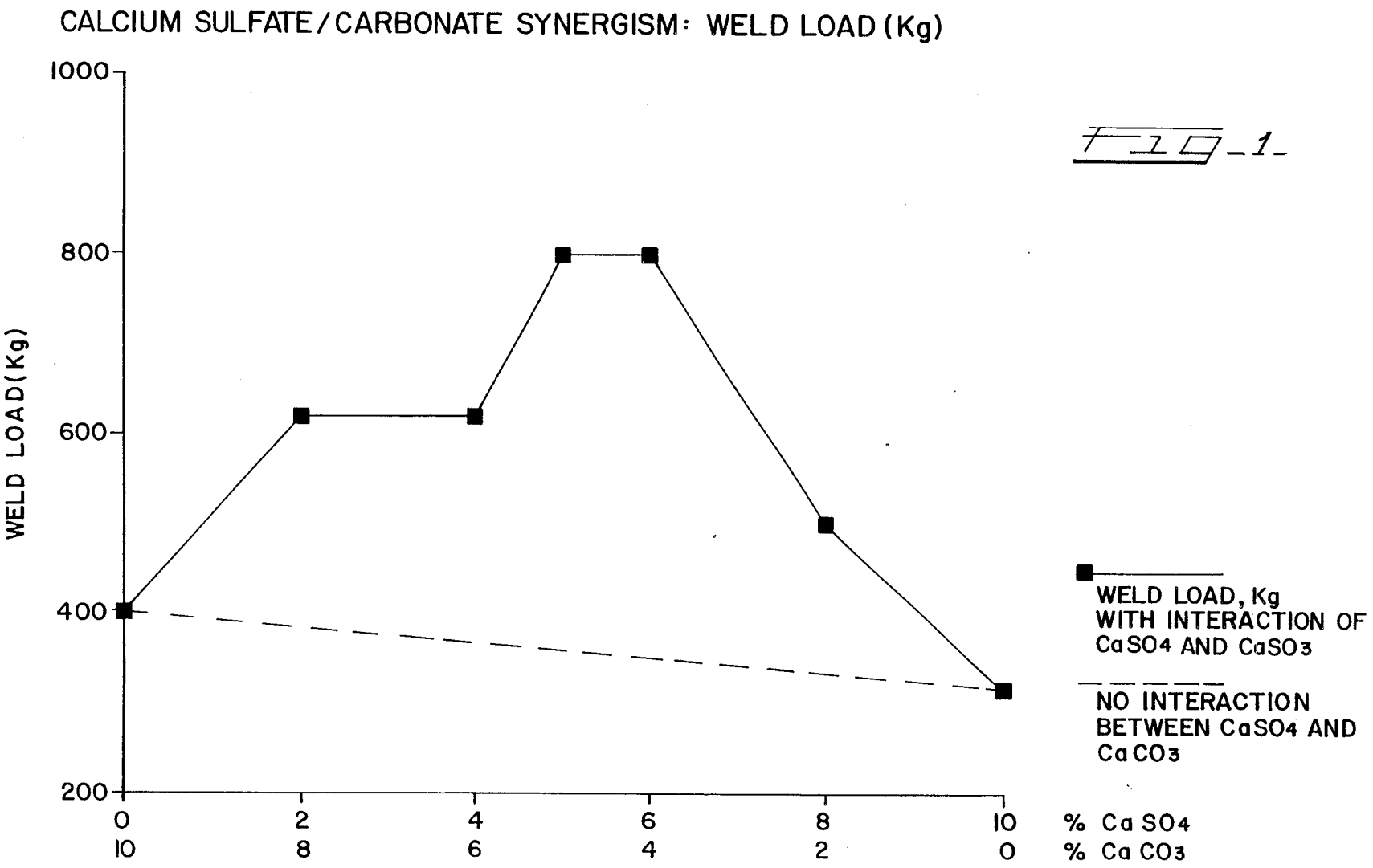
FIG. 1 is a graph of the weld load of a grease as a function of the percentage of calcium sulfate ($CaSO_4$) and calcium carbonate ($CaCO_3$)

A high performance lubricating grease is provided to effectively lubricate and grease a front-wheel drive joint. The novel front-wheel drive grease exhibits excellent extreme pressure (EP) properties and outstanding oil separation and antiwear qualities and is economical, nontoxic, and safe.

The front-wheel drive grease is chemically compatible and substantially inert to the elastomers and seals of front-wheel drive joints and provides a protective lubricating coating for the drive joints. It will not significantly corrode, deform, or degrade silicon-based elastomers of the type used in the inner front-wheel drive joints, even at high temperatures experienced in prolonged desert driving, nor will the elastomer significantly corrode, deform, or degrade front-wheel drive seals with minimal overbasing from calcium oxide or calcium hydroxide. It further will not corrode, deform, or degrade polyester and neoprene elastomers of the type used in the outer front-wheel drive joints and boots and substantially helps prevent the elastomers from cracking and becoming brittle during prolonged winter driving. It is also chemically inert to steel and copper even at the high temperatures which can be encountered in front-wheel drive joints.

The grease is an excellent lubricant between contacting metals and/or elastomeric plastics. It provides superior protection against fretting wear caused by repetitive oscillating and jostling motions of short amplitude, such as experienced by new cars during shipment by truck or railroad. It also provides outstanding protection against dynamic wear caused by sliding, rotational and oscillating motions of large amplitudes, of the type experienced in rigorous prolonged highway and mountain driving. It further accommodates rapid torque and loading increases during acceleration and sudden heavy shock loads when a front-wheel drive vehicle rides over fields, gravel roads, potholes, and bumps.

The grease is also non-reactive, passive, and noncorrosive to ferrous and non-ferrous metals, even at prolonged temperatures of 300° F. or even 350° F.

The preferred lubricating grease comprises by weight: 45% to 85% base oil, 3% to 15% polyurea thickener, 4% to 52% extreme pressure wear-resistant additives. For best results, the front-wheel drive lubricating grease comprises by weight: at least 70% base oil, 7% to 12% polyurea thickener, 4% to 22% extreme pressure wear-resistant additives.

If borated oil separation inhibitors are used, the preferred levels of borated oil separation inhibitors in the grease comprise by weight: 0.01% to 10%, and preferably not greater than 5%.

Halogenated materials in general and chlorinated paraffins in particular should be avoided in the grease because such materials: (1) exhibit corrosive tendencies at high temperatures, thereby causing extensive harm to the parts being lubricated; (2) further promote ferrous corrosion (rusting) of the parts being lubricated when even low levels of moisture are present; (3) reduce the beneficial extreme pressure and antiwear synergism of the sulfate and carbonate additives; (4) can be a health hazard; (5) can be carcinogenic; (6) are often of limited solubility in paraffinic mineral oils of the type most frequently used in lubricating greases; and (7) are often expensive, making their use in lubricants prohibitively costly.

Inhibitors

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N - diphenyl-p-phenylenediamine, 2,2,4 - trimethyldihydroquinoline oligomer, bis(4 - isopropylaminophenyl)-ether, N-acyl-p-aminophenol, N - acylphenothiazines, N of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids and their salts, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Yet other ferrous corrosion inhibitors include certain salts of aromatic acids and polyaromatic acids, such as zinc naphthenate.

Metal deactivators can also be added to prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines.

Stabilizers, tackiness agents, dropping-point improvers, lubricating agents, color correctors, and/or odor control agents can also be added to the additive package.

Base Oil

The base oil can be naphthenic oil, paraffinic oil, aromatic oil, or a synthetic oil such as a polyalphaolefin polyester, diester, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol- 2-pentoxy) disilicone, poly(methyl)siloxane, and poly(methyl)-phenylsiloxane.

The preferred base oil comprises about 60% by weight of a refined solvent-extracted hydrogenated dewaxed base oil, preferably 850 SUS oil, and about 40% by weight of another refined solvent-extracted hydrogenated dewaxed base oil, preferably 350 SUS oil, for better results.

Thickener

Polyurea thickeners are preferred over other types of thickeners because they have high dropping points. The polyurea thickener does not melt or dissolve in the oil even at temperatures of 500° F. Polyurea thickeners are also advantageous because they have inherent antioxidant characteristics, work well with other antioxidants, and are compatible with all the elastomers and seals of frontwheel drive joints.

The polyurea comprising the thickener can be prepared in a pot, kettle, bin, or other vessel by reacting an amine, such as a fatty amine, with diisocyanate, or a polymerized diisocyanate, and water. Other amines can also be used.

EXAMPLE 1

Polyurea thickener was prepared in a pot by adding: (a) about 30% by weight of a solvent extracted neutral base oil containing less than 0.1% by weight sulfur with a viscosity of 600 SUS at 100° F. and (b) about 7.45% by weight of primary oleyl amine. The primary amine base oil was then mixed for 30–60 minutes at a maximum temperature of 120° F. with about 5.4% by weight of an isocyanate, such as 143 L manufactured by Dow Chemical Company. About 3% by weight water was then added and stirred for about 20 to 30 minutes, before removing excess free isocyanates and amines.

The polyurea thickener can also be prepared, if desired, by reacting an amine and a diamine with diisocyanate in the absence of water. For example, polyurea can be prepared by reacting the following components:

1. A diisocyanate or mixture of diisocyanates having the formula OCN—R—NCO, wherein R is a hydrocarbylene having from 2 to 30 carbons, preferably from 6 to 15 carbons, and most preferably 7 carbons.
2. A polyamine or mixture of polyamines having a total of 2 to 40 carbons and having the formula:

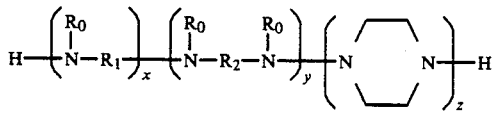

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

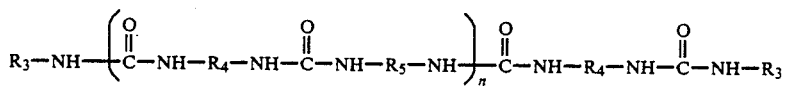

(1)

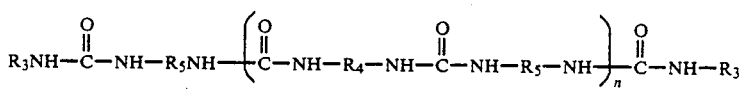

(2)

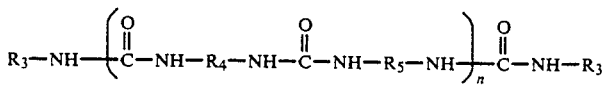

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

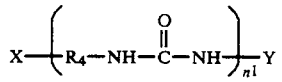

wherein $n^1$ is an integer of 1 to 3, $R_4$ is defined supra; X and Y are monovalent radicals selected from Table 1 below:

TABLE I

| X | Y |
|---|---|
| $R_7-C(=O)-NH-$ | $R_7-C(=O)-NH-R_5-$ |
| 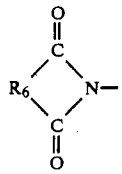 | 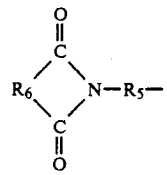 |
| | $R_8-$ |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

Biurea (diurea) may be used as a thickener, but it is not as stable as polyurea and may shear and loose consistency when pumped. If desired, triurea can also be included with or used in lieu of polyurea or biurea.

Calcium soap thickeners may also be used, although polyurea thickeners are preferred for best results.

Calcium soap thickeners may be either simple soaps or complex soaps. Calcium soap thickeners are prepared with a calcium containing base and a fatty monocarboxylic acid, ester, amide, anhydride, or other fatty monocarboxylic acid derivative. When the two materials are reacted together - usually while slurried dispersed, or otherwise suspended in a base oil - a calcium carboxylate salt, or mixture of salts is formed in the base oil. The calcium salt or salts formed thicken the oil, thereby facilitating a grease-like texture. During the reaction, water may or may not be present to assist in the formation of thickener.

In hydrous calcium-thickened greases, some added water may be retained in the final calcium soap grease as "tie water." This water is required to give permanence to the grease consistency. If the grease is heated much above 212° F., the tie water is lost, and with it the grease consistency. Such hydrous calcium greases are referred to as "cup greases," and usually do not perform well as front-wheel drive greases where performance at temperatures of 300° F. are encountered.

Simple calcium soap thickened greases do not require tie water and are referred to as anhydrous calcium soap greases. Anhydrous simple calcium soap thickeners can be quite useful for front-wheel drive greases and can comprise a minor to a substantial portion of monocarboxylic acids or fatty acid derivatives, preferably a hydroxyl group on one or more of the carbon atoms of the fatty chain for better stability of grease structure. The added polarity afforded by this hydroxyl group eliminates the need for tie water. Anhydrous simple calcium soap thickened greases are best used at lower temperatures since their dropping points are usually within the range of 300° F. to 390° F.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

Desirably, monocarboxylic fatty acids or their derivatives used in simple calcium soap thickeners have a moderately high molecular weight: 7 to 30 carbon atoms, preferably 12 to 30 carbon atoms, and most preferably 18 to 22 carbon atoms, such as lauric, myristic, palmitic, stearic, behenic, myristoleic, palmitoleic, oleic, and linoleic acids. Also, vegetable or plant oils such as rapeseed, sunflower, safflower, cottonseed, palm, castor and corn oils and animal oils such as fish oil, hydrogenated fish oil, lard oil, and beef oil can be used as a source of monocarboxylic acids in simple calcium soap thickeners. Various nut oils or the fatty acids derived therefrom may also be used in simple calcium soap thickeners. Most of these oils are primarily triacylglycerides. They may be reacted directly with the calcium containing base or the fatty acids may be cleaved from the triglyceride backbone, separated, and then reacted with the calcium containing base as free acids.

Hydroxy-monocarboxylic acids used in simple anhydrous calcium soap thickeners can include any counterpart to the preceding acids. The most widely used hydroxy-monocarboxylic acids are 12-hydroxystearic acid, 14-hydroxystearic acid, 16-hydroxystearic acid, 6-hydroxystearic acid and 9,10-dihydroxystearic acid. Likewise, any fatty acid derivatives containing any of the hydroxy-carboxylic acids may be used. In general, the monocarboxylic acids and hydroxy-monocarboxylic acids can be saturated or unsaturated, straight or branch chained Esters, amides, anhydrides, or any other derivative of these monocarboxylic acids can be used in lieu of the free acids in simple anhydrous calcium soap thickeners. The preferred monocarboxylic and hydroxy-monocarboxylic acid derivative is free carboxylic acid, however, other derivatives, such as those described above, can be used depending on the grease processing conditions and the application for which the grease is to be used.

When preparing simple anhydrous calcium soap thickeners by reacting the calcium base and the monocarboxylic acid, or mixture of monocarboxylic acids or derivatives thereof, it is preferred that the calcium base be added in an amount sufficient to react with all the acids and/or acid derivatives. It is also sometimes advantageous to add an excess of calcium base to more easily facilitate a complete reaction. The amount of excess calcium base depends on the severity of processing which the base grease will experience. The longer the base grease is heated and the higher the maximum heat treatment temperature, the less excess calcium base is required. In the preferred front-wheel drive grease, a calcium sulfate and calcium carbonate additive system is added as preformed solids during the heat treatment step, and little or no excess calcium base need be added since both calcium sulfate and calcium carbonate are basic materials capable of reacting with monocarboxylic acids.

In simple anhydrous calcium soap thickener greases, the thickener forming reaction is usually carried out at somewhat elevated temperatures, 150° F. to 320° F. Water may or may not be added to facilitate a better or more complete reaction. Preferably, any water added at the beginning of the processing as well as water formed from the thickener reaction is evaporated by heat, vacuum, or both. The thickener reaction is generally carried out after the addition of some base oil as previously described. After the thickener has been formed and any water removed, additional base oil can be added to the anhydrous base grease. During preparation, the base grease can be heat treated to a temperature ranging from about 250° F. to about 320° F. The concentration of base grease can be reduced with more base oil, additives, and other ingredients used to produce the finished grease product.

In addition to simple calcium soap thickener, calcium complex soap thickener can be used. Calcium complex soap thickener comprises the same two ingredients described in the simple calcium soap case, namely, a calcium-containing base and monocarboxylic acids, at least part of which should preferably be hydroxy-monocarboxylic acids. Additionally, calcium complex soap thickeners comprise a shorter chain monocarboxylic acid. Esters, amides, anhydrides, or other carboxylic acid derivatives can also be used. The short chain fatty acid in calcium complex soap greases can have from 2 to 12 carbons, preferably 2 to 10, and most preferably 2 to 6. While the short chain acid in calcium complex soap thickener can be alkyl or aryl, unsaturated or saturated, straight chain or branched, alkyl, straight chain, saturated acids are preferred, such as acetic acid, due to its low cost and availability. Propionic acid can also be used with similar results. Butyric, valeric, and caproic acids can be used, but are not preferred in part because of their offensive odors.

In calcium complex soap thickeners, the ratio of short chain acids to long chain acids can vary widely depending on the desired grease yield and dropping point. The lower the ratio of short chain acids to long chain acids, the less will be the dropping point elevation above that of a simple, anhydrous calcium soap grease. The larger the ratio of short chain acid to long chain acid, however, the poorer the grease yield because of the less effective thickening power of the calcium salt of the short chain carboxylic acid.

Processing conditions for manufacture of calcium complex greases are similar to those described for simple calcium greases. An amount of the calcium base is slurried in some of the base oil. Then the long chain monocarboxylic acids and short chain carboxylic acids are added. They may be added together or separately. Water may or may not also be added. If water is added to the thickener, then the water is preferably vaporized or otherwise removed after the thickener has been formed. This can be accomplished by heat, vacuum, or both. Once formed and dried, the calcium complex base grease can be conditioned with a heat treatment step, such as by heating the grease to a temperature ranging from about 250° F. to about 400° F., preferably, to at least about 300° F.

Mixtures of polyurea and simple anhydrous calcium soap can also be used as a thickener system for the greases of this invention. Likewise, mixtures of polyurea and calcium complex soap can also be used as a thickener system for the greases of this invention.

Additives

In order to attain extreme pressure properties, antiwear qualities, elastomeric compatibility, high temperature stability, high temperature non-corrosivity, and a safe, non-toxic product, the additives in the additive package comprise calcium sulfate and calcium carbonate Advantageously, the use of both calcium carbonate and especially calcium sulfate in the additive package adsorbs oil in a manner similar to polyurea and, therefore, less polyurea thickener is required to achieve the desired grease consistency. Typically, the cost of calcium sulfate and calcium carbonate are much less than polyurea and, therefore, the grease can be formulated at lower costs.

Preferably, the calcium sulfate and the calcium carbonate are each present in the additive package in an amount ranging from 0.1% to 20% by weight of the grease. For ease of handling and manufacture, the calcium sulfate and calcium carbonate are each most preferably present in the additive package in an amount ranging from 2% to 10% by weight of the grease.

Desirably, the maximum particle sizes of the calcium sulfate and the calcium carbonate are 100 microns and the calcium sulfate and the calcium carbonate are of foodgrade quality to minimize abrasive contaminants and promote homogenization. Calcium carbonate can be provided in dry solid form as $CaCO_3$. Calcium sulfate can be provided in dry solid form as $CaSO_4$ or any of the several available solid hydrate forms.

If desired, the calcium carbonate and/or calcium sulfate can be added, formed, or created in situ in the grease as by-products of chemical reactions. For example, calcium carbonate can be produced by bubbling carbon dioxide through calcium hydroxide in the grease. Calcium sulfate can be produced by reacting sulfuric acid with calcium oxide or calcium hydroxide in the grease. Other methods for forming calcium carbonate and/or calcium sulfate can also be used.

The preferred sulfate additive is anhydrous calcium sulfate for best results. While calcium sulfate is the preferred, other sulfate additives can be used, if desired, in conjunction with or in lieu of calcium sulfate, such as the sulfates of Group 2a alkaline earth metal, such as beryllium, magnesium, calcium, strontium, and barium, or the sulfates of a Group 1a alkali metal, such as lithium, sodium, and potassium.

Desirably, calcium sulfate is less expensive, less toxic, more readily available, and safer. Calcium sulfate is also superior to calcium bisulfate. Calcium sulfate has unexpectedly been found to be compatible and non-corrosive with elastomers and seals of front-wheel drive joints. Calcium sulfate is also essentially water insoluble and will not washout of the grease when contamination by water occurs. Calcium bisulfate however, was found to corrode, crack, and/or degrade some elastomers and seals of front-wheel drive joints. Calcium bisulfate was also undesirably found to be water soluble and washout of the grease when the front-wheel drive joint was contacted with water, which significantly decreased the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium.

Desirably, calcium carbonate is less expensive, less toxic, more readily available, safer, and more stable than other carbonates. Calcium carbonate is also superior to calcium bicarbonate. Calcium carbonate has been unexpectedly found to be compatible and non-corrosive with elastomers and seals of front-wheel drive joints and is water insoluble. Calcium bicarbonate, on the other hand, has been found to corrode, crack, and/or degrade many of the elastomers and seals of front-wheel drive joints. Calcium bicarbonate has also been undesirably found to be water soluble and experiences many of the same problems as calcium bisulfate, as described above. Also, calcium bicarbonate is disadvantageous for another reason. During normal use, either the base oil or antioxidant additives will undergo a certain amount of oxidation. The end products of this oxidation are invariably acidic. These acid oxidation products can react with calcium bicarbonate to undesirably produce gaseous carbon dioxide. If the grease is used in a sealed application, such as a constant-velocity joint, the evolution of gaseous reaction products, such as carbon dioxides, could, in extreme cases, cause ballooning of the elastomeric seal. This would in turn place additional stress on the seal and seal clamps and could ultimately result in a seal failure and rupture. Calcium carbonate, however, is much more resistant to producing carbon dioxide, since its alkaline reserve is much higher than calcium bicarbonate.

In another preferred form, the additive package further comprises calcium hydroxide. It has been found that a relatively minor level of calcium hydroxide, when added to the front-wheel drive grease, improves the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the grease. For best results, the calcium hydroxide, when present, should be present at 0.1% to 2% by weight of the grease. Calcium hydroxide may be provided as $Ca(OH)_2$. If desired, the calcium hydroxide can be produced, formed, or created in situ in the grease as bi-products of chemical reactions designed to produce calcium hydroxide.

The use of both calcium sulfate and calcium carbonate together in the additive package of the front-wheel drive grease was found to produce unexpected superior results in comparison to a similar grease with greater amounts by weight of: (a) calcium sulfate alone in the absence of calcium carbonate, or (b) calcium carbonate alone in the absence of calcium sulfate.

Oil Separation Inhibitors

It was found that borates or boron-containing materials such as borated amine, when used in polyurea greases in the presence of a mixture of calcium sulfate and calcium carbonate, act as an oil separation inhibitor. This discovery is also highly advantageous since oil separation, or bleed, as to which it is sometimes referred, is a property which frequently needs to be minimized.

Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company.

Other useful borates include other borates of Group 1a alkali metals, borates of Group 2a alkaline earth metals, stable borates of transition metals (elements), such as zinc, copper, and tin, boric oxide, and combinations of the above.

The front-wheel drive grease contains 0.01% to 10%, preferably 0.1% to 5%, and most preferably 0.25% to 2.5%, by weight borated material (borated amine).

It was also found that borated inhibitors minimized oil separation even when temperatures were increased from 210° F. to 300° F. or 350° F. Advantageously, borated inhibitors restrict oil separation over a wide temperature range. This is in direct contrast to the traditional oil separation inhibitors, such as high molecular weight polymer inhibitors such as that sold under the brand name of Paratac by Exxon Chemical Company U.S.A. Traditional polymeric additives often impart an undesirable stringy or tacky texture to the lubricating grease because of the extremely high viscosity and long length of their molecules. As the temperature of the grease is raised, the viscosity of the polymeric additive within the grease is substantially reduced as is its tackiness. Tackiness restricts oil bleed. As the tackiness is reduced, the beneficial effect on oil separation is also reduced. Borated amine additives do not suffer from this flaw since their effectiveness does not depend on imparted tackiness. Borated amines do not cause the lubricating grease to become tacky and stringy. This is desirable since, in my applications of lubricating greases, oil bleed should be minimized while avoiding any tacky or stringy texture.

It is believed that borated amines chemically interact with the calcium sulfate and calcium carbonate in the grease. The resulting species then interacts with the polyurea and/or calcium soap thickener system in the grease to form an intricate, complex system which effectively binds the lubricating oil.

Another benefit of borated oil separation inhibitors and additives over conventional "tackifier" oil separation additives is their substantially complete shear stability. Conventional tackifier additives comprise high molecular weight polymers with very long molecules. Under conditions of shear used to physically process (mill) lubricating greases, these long molecules are highly prone to being broken into much smaller fragments. The resulting fragmentary molecules are greatly reduced in their ability to restrict oil separation. To avoid this problem, when conventional tackifiers are used to restrict oil separation in lubricating greases, they are usually mixed into the grease after the grease has been milled. This requires an additional processing step in the lubricating grease manufacturing procedure. Advantageously, borated amines and other borated additives can be added to the base grease with the other additives, before milling, and their properties are not adversely affected by different types of milling operations.

In contrast to conventional tackifiers, borated amines can be pumped at ordinary ambient temperature into manufacturing kettles from barrels or bulk storage tanks without preheating.

Inorganic borate salts, such as potassium triborate, provide an oil separation inhibiting effect similar to borated amines when used in polyurea and/or calcium soap thickened greases in which calcium sulfate and calcium carbonate are also present. It is believed that the physio-chemical reason for this oil separation inhibiting effect is similar to that for borated amines. This discovery is particularly useful since inorganic borate salts are not usually used as oil separation inhibitors. The advantages of borated amines over conventional tackifier additives are also applicable in the case of inorganic borate salts.

EXAMPLE 2

This test served as the control for subsequent tests. A base grease was formulated with about 15% by weight polyurea thickener and about 85% by weight paraffinic solvent-extracted base oil. The polyurea thickener was prepared in a vessel in a manner similar to Example 1. The paraffinic solvent-extracted base oil was mixed with the polyurea thickener until a homogeneous base grease was obtained. No additive package was added to the base grease. Neither calcium sulfate nor calcium carbonate were present in the base grease The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 3

A front-wheel drive grease was prepared in a manner similar to Example 2, except that about 2% by weight of finely divided, calcium sulfate with an average mean diameter of less than 4.40 microns was added to the base grease. The resultant mixture was mixed and milled in a roll mill until a homogeneous grease was produced. The Four Ball EP Test showed that the EP/antiwear properties of the grease were significantly increased with calcium sulfate.

| | |
|---|---|
| Last nonseizure load, kg | 40 |
| Weld load, kg | 200 |
| Load wear index | 31.0 |

EXAMPLE 4

A front-wheel drive grease was prepared in a manner similar to Example 3, except that about 5% by weight of finely divided, calcium sulfate was added to the base grease. The resultant mixture was mixed and milled in a roll mill until a homogeneous grease was produced. The Four Ball EP Test showed that the EP/antiwear properties of the grease were further increased with calcium sulfate.

| | |
|---|---|
| Last nonseizure load, kg | 80 |
| Weld load, kg | 250 |
| Load wear index | 42.5 |

EXAMPLE 5

A front-wheel drive grease was prepared in a manner similar to Example 4, except that about 10% by weight calcium sulfate was added to the base grease. The Four Ball EP Test showed that the EP/antiwear properties were further increased with more calcium sulfate.

| | |
|---|---|
| Last nonseizure load, kg | 63 |
| Weld load, kg | 315 |
| Load wear index | 48.6 |

EXAMPLE 6

A front-wheel drive grease was prepared in a manner similar to Example 5, except that about 15% by weight calcium sulfate was added to the base grease. The Four Ball EP Test showed that the EP/antiwear properties of the grease were further increased.

| | |
|---|---|
| Last nonseizure load, kg | 63 |
| Weld load, kg | 400 |
| Load wear index | 63.6 |

EXAMPLE 7

A front-wheel drive grease was prepared in a manner similar to Example 6, except that about 20% by weight calcium sulfate was added to the base grease. The Four Ball EP Test showed that the load wear index of the grease was somewhat better than the 15% calcium sulfate grease of Example 6, but the last nonseizure load had dropped significantly.

| | |
|---|---|
| Last nonseizure load, kg | 20 |
| Weld load, kg | 400 |
| Load wear index | 65.3 |

EXAMPLE 8

A front-wheel drive grease was prepared in a manner similar to Example 2, except that about 10% by weight of finely divided calcium carbonate with a mean particle diameter less than 2 microns, was added to the base grease. The resultant grease was mixed and milled until it was homogeneous. The Four Ball EP Test showed that the weld load and load wear index of the calcium carbonate grease were better than the base grease of Example 2.

| | |
|---|---|
| Last nonseizure load, kg | 80 |
| Weld load, kg | 400 |
| Load wear index | 65.8 |

EXAMPLE 9

A front-wheel drive grease was prepared in a manner similar to Example 8, except that about 15% by weight of finely divided calcium carbonate was added to the base grease. The resultant grease was mixed and milled until it was homogeneous. The Four Ball EP Test showed little improvement over the grease of Example 8.

| | |
|---|---|
| Last nonseizure load, kg | 80 |
| Weld load, kg | 400 |
| Load, wear index | 66.9 |

EXAMPLE 10

A front-wheel drive grease was prepared in a manner similar to Example 9, except that about 20% by weight of finely divided calcium carbonate was added to the base grease. The resultant grease was mixed and milled until it was homogeneous. The Four Ball EP Test showed little improvement over the grease of Example 9.

| | |
|---|---|
| Last nonseizure load, kg | 80 |
| Weld load, kg | 400 |
| Load wear index | 67.1 |

EXAMPLE 11

A front-wheel drive grease was prepared in a manner similar to Example 2, except that about 5% by weight of finely divided calcium sulfate and about 5% by weight of finely divided calcium carbonate were both added to the base grease. The calcium sulfate had a mean particle diameter of less than 4.40 microns and the calcium carbonate had an average mean particle diameter less than 2 microns. The resultant grease was mixed and milled until it was homogeneous. The Four Ball EP Test showed that the EP/antiwear properties of the grease were surprisingly better than the base grease of Example 2 and the greases of Examples 3–10.

| | |
|---|---|
| Last nonseizure load, kg | 80 |
| Weld load, kg | 800 |
| Load wear index | 133.4 |

The results of Example 11 are extremely surprising and unexpected. Even though the grease of Example 11 had 5% each of calcium sulfate and calcium carbonate, it demonstrated far superior EP/antiwear properties than greases with 10%, or 15%, or even 20% of either calcium sulfate alone or calcium carbonate alone.

EXAMPLES 12–14

To further determine the magnitude of this synergism, three more greases were made in a manner similar to Example 11 but with less levels of both calcium sulfate and calcium carbonate than that of Example 11. Compositions and Four Ball EP Test results are tabulated below.

| | Example Number | | |
|---|---|---|---|
| | 12 | 13 | 14 |
| Calcium sulfate, % wt | 4.0 | 3.0 | 2.0 |
| Calcium carbonate, % wt | 4.0 | 3.0 | 2.0 |
| Last nonseizure load, kg | 63 | 32 | 80 |
| Weld load, kg | 800 | 800 | 500 |
| Load wear index | 97.0 | 100.4 | 59.3 |

These results are even more surprising and unexpected than those of Example 11. Even when only 2% each of calcium sulfate and calcium carbonate were both used, test results were superior to that obtained with test greases containing 10% of calcium sulfate alone or 10% of calcium carbonate alone. When 3% each of calcium sulfate and calcium carbonate was used, test results were superior to that obtained with test greases containing 10%, or 15%, or even 20% of either calcium sulfate alone or calcium carbonate alone.

EXAMPLES 15–18

To further define the remarkable synergism of an additive mixture of both calcium sulfate and calcium carbonate, several more samples were made in a manner similar to that of Example 11. The combined levels of calcium sulfate and calcium carbonate were maintained at 10% for all these samples. Compositions and Four Ball EP Test data are tabulated below:

| | Example Number | | | |
|---|---|---|---|---|
| | 15 | 16 | 17 | 18 |
| Calcium sulfate, % wt | 8.0 | 6.0 | 4.0 | 2.0 |
| Calcium carbonate, % wt | 2.0 | 4.0 | 6.0 | 8.0 |
| Last nonseizure load, kg | 80 | 80 | 80 | 80 |
| Weld load, kg | 500 | 800 | 620 | 620 |
| Load wear index | 67.7 | 100.5 | 86.1 | 83.7 |

Figure 2:
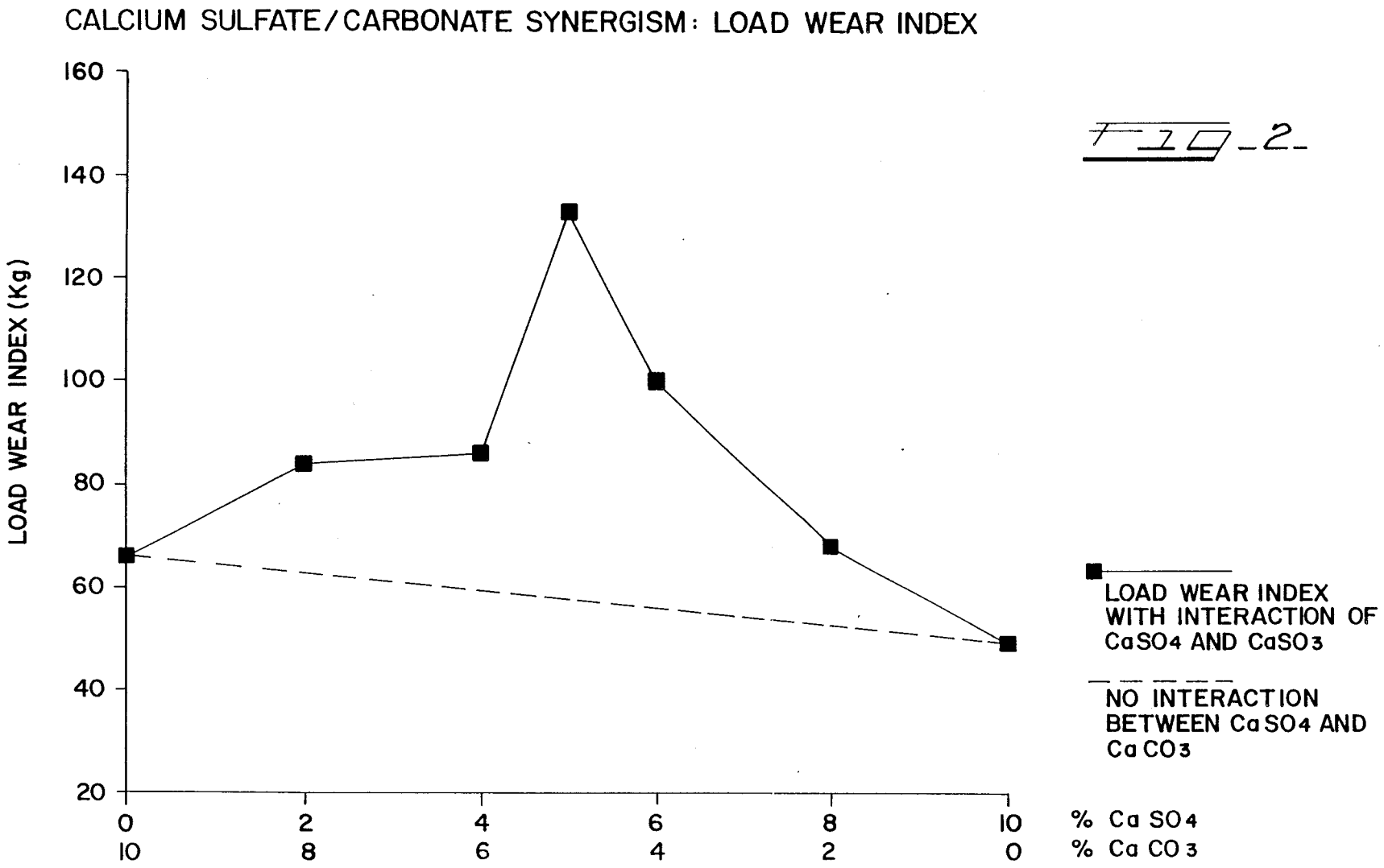
FIG. 2 is a graph of the load-wear index of the grease as a function of the percentage of calcium sulfate and calcium carbonate.

The test data of Examples 15–18 as well as the test data of Examples 5, 8, and 11 distinctly show the synergistic interaction of calcium sulfate and calcium carbonate with respect to extreme pressure (EP)/antiwear properties. Graphs of this are shown in FIGS. 1 and 2.

EXAMPLE 19

A grease was prepared in a manner similar to Example 11 (containing 5% calcium sulfate and 5% calcium carbonate) except that 1% of Cereclor 63L, a chlorinated paraffin containing 63% chlorine, was also added to the grease. The resulting grease was subjected to the Four Ball EP Test and gave a load wear index lower than the 133.4 of Example 11.

| | |
|---|---|
| Last nonseizure load, kg | 80 |
| Weld load, kg | 800 |
| Load wear index | 107.7 |

EXAMPLE 20

A grease was prepared in a manner similar to Example 19 except that 4% of Cereclor 63L, a chlorinated paraffin containing 63% chlorine, was also added to the grease. The resulting grease was subjected to the Four Ball EP Test and gave a load wear index greater than that of Example 19 but still lower than the 133.4 of Example 11.

| | |
|---|---|
| Last nonseizure load, kg | 80 |
| Weld load, kg | 800 |
| Load wear index | 119.1 |

EXAMPLE 21

The chlorinated grease of Example 20 was subjected to a steel strip corrosion test. This test is similar to the ASTM D4048 Copper Strip Corrosion Test except that a polished steel strip is used instead of a polished copper strip. The test was performed at 300° F. for 24 hours after which time the jar of grease with the immersed steel strip was removed and allowed to cool. Then the steel strip was removed from the jar and the excess grease was removed from the steel strip by gentle blotting with a laboratory tissue paper followed by washing with a stream of heptane from a plastic squirt bottle. The steel strip showed very obvious signs of chemical attack. Etching, pitting, and a dark brown deposition covered the steel strip. The strip was placed on a clean laboratory tissue paper and allowed to sit over night for 16 hours in the laboratory. The next morning the steel strip was covered with a thick layer of rust. This rusting had occurred from the moisture content of the air and was catalyzed by residual iron chloride which had formed on the steel strip surface. This residual iron chloride had formed during the test from the dehydrohalogenation and/or dechlorination of the chlorinated paraffin additive and concomitant reaction of hydrogen chloride and/or chlorine with the steel surface.

EXAMPLE 22

The non-halogenated grease of Example 11 was subjected to the same steel strip corrosion test described in Example 21. At the conclusion of the test the steel strip had not changed its appearance. It was still shiny and polished. After sitting in the laboratory over night it still had not changed its appearance.

EXAMPLE 23

A chlorinated grease was prepared similar to Example 19 except that 2% calcium sulfate, 20% calcium carbonate, and 2% Cereclor 63L by weight was added to the grease. The resulting grease was tested in the same way as Example 21 and the same results were obtained. The chlorinated grease failed miserably due to catastrophic chemical attack and resulting massive rusting in air.

EXAMPLE 24

A non-halogenated grease was prepared similar to that of Example 23 except that no Cereclor 63L was added. The grease was tested by the same steel strip corrosion test of Example 23 and gave the same outstanding results of Example 22. The steel strip was shiny and polished and no rusting formed after overnight standing in open air.

EXAMPLE 25

A non-halogenated grease identical to that of Example 13 (3% calcium sulfate and 3% calcium carbonate) was subjected to a modified Four Ball EP Test in which the run was for 25 seconds at 250 kg load. Immediately after this 25 second run, the assembly holding the four balls was removed and the temperature of the surface of the top ball was measured using an Alnor pyrometer. Then the grease was wiped away from the area around the bottom three balls and the surface temperature of one of the bottom balls was likewise measured. The entire process of obtaining the two temperature readings took about 10 seconds from the time that the ball-holding assembly was removed. This was done to minimize any cooling of the balls. After the temperatures were recorded, the average of the scar diameters of the bottom three balls was obtained in a manner consistent with the ASTM D2596 Four Ball EP Test procedure. Then this test was repeated with new balls using a 10 second run at 315 kg. Results are given below:

| | |
|---|---|
| 250 kg, 25 seconds | |
| Top Ball Temperature, °F. | 145 |
| Bottom Ball Temperature, °F. | 165 |
| Scar Diameter, mm | 1.86 |
| Scar Appearance | No Discoloration |
| 315 kg, 10 seconds | |
| Top Ball Temperature, °F. | 135 |
| Bottom Ball Temperature, °F. | 128 |
| Scar Diameter, mm | 1.68 |
| Scar Appearance | No Discoloration |

EXAMPLE 26

A grease was prepared in a manner similar to Example 25 except that no calcium sulfate and no calcium carbonate was added. Instead, 6% by weight of the grease of a typical sulfur and phosphorus-based additive system, Anglamol 6063A, sold by Lubrizol Corp. was added to the grease. The grease was tested by the same procedure described in Example 25 and gave the following results:

| | |
|---|---|
| 250 kg, 25 seconds | |
| Top Ball Temperature, °F. | 195 |
| Bottom Ball Temperature, °F. | 205 |
| Scar Diameter, mm | 2.00 |
| Scar Appearance | Black |

-continued

| | |
|---|---|
| 315 kg, 10 seconds | |
| Top Ball Temperature, °F. | 173 |
| Bottom Ball Temperature, °F. | 150 |
| Scar Diameter, mm | 2.00 |
| Scar Appearance | Black |

Results of Example 26 are much inferior to that of Example 25. Example 25 greatly reduced the frictional heat generated when compared to Example 26. Likewise, the amount of wear in Example 25 was much less than Example 26.

EXAMPLE 27

A front-wheel drive grease was prepared in a manner similar to Example 6, except as described below. The polyurea thickener was prepared in a manner similar to Example 1 by reacting 5.15 pounds of a fatty amine, sold under the brand name Armeen T by Armak Industries Chemicals Division, 5.85 pounds of a diisocyanate, sold under the brand name Isonate 143L by Dow Chemical Company, and 2,700 ml of water in 25.67 pounds of a base oil. The base oil had a viscosity of 850 SUS at 100° F. and was a paraffinic, solvent-extracted, dewaxed, hydrogenated mineral oil. A portion of that base grease was finished as a front-wheel drive grease by adding calcium sulfate and calcium carbonate. Corrosive inhibiting agent, sold under the brand name of Nasul BSN by R. T. Vanderbilt Co. was added to the grease for ferrous corrosion (rust) protection. The anti-oxidants were a mixture of arylamines. Additional amounts of the base oil described above were added. Also, paraffinic, solvent-extracted, dewaxed, hydrogenated mineral oil having a viscosity of 350 SUS at 100° F. was added to the grease. The grease was stirred and subsequently milled with a Gaulin Homogenizer at a pressure of 7,000 psi until a homogeneous grease was produced. The grease had the following composition:

| Component | % (wt) |
|---|---|
| 850 SUS Oil | 49.85 |
| 350 SUS Oil | 33.23 |
| Polyurea Thickener | 10.80 |
| Calcium Sulfate | 2.16 |
| Calcium Carbonate | 2.16 |
| Nasul BSN | 1.08 |
| Mixed Aryl Amines | 0.22 |

The grease was tested and had the following performance properties:

| | |
|---|---|
| Work Penetration, ASTM D217 | 304 |
| Dropping Point, ASTM D2265, °F. | 505 |
| Four Ball Wear, ASTM D2266 at 40 kg, 1200 rpm for 1 hr | 0.48 |
| Four Ball EP, ASTM D2596 | |
| last nonseizure load, kg | 80 |
| weld load, kg | 500 |
| load wear index | 52.2 |
| Fretting Wear, ASTM D4170, 24 hr mg loss/race set | 1.1 |
| Copper Strip Corrosion, ASTM D4048 300° F., 24 hr | 1A |
| Steel Strip Corrosion, 300° F., 24 hr. | No Discoloration |
| Elastomer Compatibility with Polyester | |
| % loss tensile strength | 17.3 |
| % loss maximum elongation | 5.94 |
| Elastomer Compatibility with Silicone | |

-continued

| | |
|---|---|
| % loss tensile strength | 0 |
| % loss maximum elongation | 3.9 |

EXAMPLE 28

The grease of Example 27 was subjected to an oil separation and cone test (bleed test), SDM 433 standard test of the Saginaw Steering Gear Division of General Motors. In the test, the grease was placed on a 60 mesh nickel screen cone. The cone was heated in an oven for the indicated time at the listed temperature. The percentage decrease in the weight of the grease was measured. The test showed that minimum oil loss occurred even at higher temperatures over a 24-hour time period. The results were as follows:

| time (hr) | temp (°F.) | % oil loss |
|---|---|---|
| 24 | 212 | 2.6 |
| 24 | 300 | 1.4 |
| 24 | 350 | 3.0 |

EXAMPLE 29

The grease of Example 27 was subjected to an Optimol SRV stepload test under conditions recommended by Optimol Lubricants, Inc. and used by Automotive Manufacturers such as General Motors for lubricant evaluation. This method was also specified by the U.S. Air Force Laboratories Test Procedure of Mar. 6, 1985. In the test, a 10 mm steel ball is oscillated under load increments of 100 newtons on a lapped steel disc lubricated with the grease being tested until seizure occurs. The grease passed the maximum load of 800 newtons at 80° C. When the test was repeated at 150° C., the grease passed the maximum load of 600 Newtons.

EXAMPLE 30

Another front-wheel drive grease was prepared from a second portion of the base polyurea grease described in the preparation of Example 27. The grease was finished similar to Example 27 except that a borated amine rust inhibitor, Lubrizol 5391, sold by Lubrizol Corp. was also added to the grease. The grease had the following composition:

| Component | % (wt) |
|---|---|
| 850 SUS Oil | 49.85 |
| 350 SUS Oil | 33.23 |
| Polyurea Thickener | 10.80 |
| Calcium Sulfate | 2.16 |
| Calcium Carbonate | 2.16 |
| Nasul BSN | 1.08 |
| Lubrizol 5391 | 0.50 |
| Mixed Aryl Amines | 0.22 |

The grease was tested and had the following performance properties:

| | |
|---|---|
| Worked Penetration, ASTM D217 | 308 |
| Dropping Point, ASTM D2265, °F. | 506 |
| Four Ball Wear, ASTM D2266 at 40 kg, 1200 rpm for 1 hr | 0.49 |
| Four Ball EP, ASTM D2596 | |
| last nonseizure load, kg | 80 |

-continued

| | |
|---|---|
| weld load, kg | 400 |
| load wear index | 45.5 |
| Fretting Wear, ASTM D4170, 24 hr mg loss/race set | 0.7 |
| Copper Strip Corrosion, ASTM D4048 300° F., 24 hr | 1A |
| Steel Strip Corrosion, 300° F., 24 hr. | No Discoloration |
| Elastomer Compatibility with Polyester | |
| % loss tensile strength | 12.4 |
| % loss maximum elongation | 7.15 |
| Elastomer Compatibility with Silicone | |
| % loss tensile strength | 4.66 |
| % loss maximum elongation | 15.2 |

EXAMPLE 31

The borated grease of Example 30 was subjected to an oil separation and cone test (bleed test), SDM 433, as described in Example 28. The test showed that minimum oil loss occurred even at higher temperatures over a 24-hour time period and that at the highest test temperature results were even somewhat improved over the outstanding results of Example 28.

| time (hr) | temp (°F.) | % oil loss |
|---|---|---|
| 24 | 212 | 2.5 |
| 24 | 300 | 2.1 |
| 24 | 350 | 1.4 |

EXAMPLE 32

The borated grease of Example 30 was subjected to the Optimol SRV stepload test described in Example 29. The grease passed the maximum load of 900 newtons at 80° C. When the test was repeated at 150° C., the grease passed the maximum load of 600 Newtons.

EXAMPLES 33-34

Two front-wheel drive greases were prepared in a manner similar to Example 27, except as described below. The polyurea thickener was prepared in a manner similar to Example 1 by reacting 5.15 pounds of a fatty amine, sold under the brand name Armeen T by Armak Industries Chemicals Division, 5.85 pounds of a diisocyanate similar to Isonate 143L but manufactured by Mobay Chemical Corporation, and 2,700 ml of water in 25.67 pounds of a base oil. The base oil had a viscoscity of 850 SUS at 100° F. and was a paraffinic, solvent extracted, dewaxed, hydrogenated mineral oil. Two portions of that base grease was finished as a front-wheel drive grease by adding calcium sulfate and calcium carbonate. Corrosive inhibiting agents, sold under the brand names of Nasul BSN and Nasul 729 by R. T. Vanderbilt Co., were added to the greases for ferrous corrosion protection. The anti-oxidants were a mixture of arylamines. Additional amounts of the base oil described above were added. Also, paraffinic, solvent extracted, dewaxed, hydrogenated mineral oil having a viscosity of 350 SUS at 100° F. was added to the grease. The grease was stirred and subsequently milled with a Gaulin Homogenizer at a pressure of 7,000 psi until a homogeneous grease was produced. The two greases had the following compositions:

| Example Number<br>Component | 33<br>% (wt) | 34<br>% (wt) |
|---|---|---|
| 850 SUS Oil | 47.82 | 47.88 |
| 350 SUS Oil | 31.88 | 31.92 |
| Polyurea Thickener | 10.00 | 9.00 |
| Calcium Sulfate | 4.55 | 5.00 |
| Calcium Carbonate | 4.55 | 5.00 |
| Nasul BSN | 1.00 | — |
| Nasul 729 | — | 1.00 |
| Mixed Aryl Amines | 0.22 | 0.20 |
| The two greases were tested and had the following performance properties: | | |
| Work Penetration, ASTM D217 | 284 | 299 |
| Dropping Point, ASTM D2265, °F. | 518 | 522 |
| Oil Separation, SDM-433, % | | |
| 212° F., 24 hr. | 1.0 | 2.1 |
| 300° F., 24 hr. | 2.0 | 1.6 |
| 350° F., 24 hr. | 4.4 | 3.6 |
| Four Ball Wear, ASTM D2266 at 40 kg, 1200 rpm for 1 hr | 0.47 | 0.48 |
| Four Ball EP, ASTM D2596 | | |
| last nonseizure load, kg | 80 | 80 |
| weld load, kg | 800 | 800 |
| load wear index | 102.4 | 96.1 |
| Optimol SRV Stepload Test, 80° C., maximum passing load, Newtons | 1,000 | 1,000 |
| Fretting Wear, ASTM D4170, 24 hr mg loss/race set | 1.2 | 3.3 |
| Copper Strip Corrosion, ASTM D4048 300° F., 24 hr | 1A | 1A |
| Steel Strip Corrosion, 300° F., 24 hr. | No Change | No Change |
| Elastomer Compatibility with Polyester | | |
| % loss tensile strength | 14.5 | 13.1 |
| % loss maximum elongation | 7.94 | 8.80 |
| Elastomer Compatibility with Silicone | | |
| % loss tensile strength | 2.94 | 3.37 |
| % loss maximum elongation | 11.8 | 16.7 |

EXAMPLES 35-36

Two front-wheel drive greases were made in a manner similar to that of Example 13 except that 1.0% Nasul BSN by weight of the grease and 0.2% Vanlube 848 by weight of the grease were added to each of the two greases. The second grease also had 0.5% calcium hydroxide by weight of the grease. The greases were subjected to the ASTM D2266 Four Ball Wear Test. The second grease which contained the additional minor amount of calcium hydroxide gave results superior to that of the first grease which contained no added calcium hydroxide.

| Example Number | 35 | 36 |
|---|---|---|
| Calcium Hydroxide, % (wt) | 0 | 0.5 |
| Four Ball Wear, ASTM D2266 at 40 kg, 1200 rpm for 1 hr | 0.53 | 0.44 |

EXAMPLES 37-38

Two greases were prepared in a manner similar to that of Examples 33-34 except for the following differences. Both greases used an amine antioxidant sold under the brand name Vanlube 848 by R. T. Vanderbilt Company, Inc. The second grease also contained a minor amount of calcium hydroxide. The two greases had the following compositions:

| Example Number<br>Component | 37<br>% (wt) | 38<br>% (wt) |
|---|---|---|
| 850 SUS Oil | 47.82 | 47.88 |
| 350 SUS Oil | 31.88 | 31.92 |
| Polyurea Thickener | 10.00 | 9.00 |
| Calcium Sulfate | 5.00 | 5.00 |
| Calcium Carbonate | 5.00 | 5.00 |
| Calcium Hydroxide | — | 0.50 |
| Nasul BSN | 1.00 | 1.00 |
| Vanlube 848 | 0.40 | 0.40 |

The two greases were tested and had the following performance properties:

| Example Number | 37 | 38 |
|---|---|---|
| Worked Penetration, ASTM D217 | 328 | 318 |
| Dropping Point, ASTM D2265, °F. | 497 | 530+ |
| Oil Separation, SDM-433, % | | |
| 212° F., 6 hr. | 2.9 | 2.5 |
| 212° F., 24 hr. | 5.4 | 4.6 |
| 300° F., 24 hr. | 2.9 | 2.5 |
| 350° F., 24 hr. | 4.3 | 4.6 |
| Four Ball Wear, ASTM D2266 at 40 kg, 1200 rpm for 1 hr | 0.55 | 0.42 |
| Four Ball EP, ASTM D2596 | | |
| last nonseizure load, kg | 80 | 80 |
| weld load, kg | 500 | 620 |
| load wear index | 77.8 | 89.5 |
| Optimol SRV Stepload Test, 80° C., maximum passing load, Newtons | 900 | 900 |
| Fretting Wear, ASTM D4170, 24 hr mg loss/race set | 0.6 | 0.3 |
| Copper Strip Corrosion, ASTM D4048 300° F., 24 hr | 1A | 1A |
| Steel Strip Corrosion, 300° F., 24 hr. | No Change | No Change |
| Elastomer Compatibility with Polyester | | |
| % loss tensile strength | 20.0 | 15.7 |
| % loss maximum elongation | 7.75 | 3.73 |
| Elastomer Compatibility with Silicone | | |
| % loss tensile strength | 6.80 | 9.95 |
| % loss maximum elongation | 15.2 | 16.9 |

EXAMPLE 39

A front-wheel drive grease was made in a manner similar to Example 27 except for the final concentration of some of the additives. Final grease composition is given below:

| Component | % (wt) |
|---|---|
| 850 SUS Oil | 46.46 |
| 350 SUS Oil | 30.98 |
| Polyurea Thickener | 10.30 |
| Calcium Sulfate | 5.15 |
| Calcium Carbonate | 5.15 |
| Calcium Hydroxide | 0.52 |
| Nasul BSN | 1.03 |
| Vanlube 848 | 0.41 |

The grease was tested and had the following performance properties:

| | |
|---|---|
| Worked Penetration, ASTM D217 | 323 |
| Dropping Point, ASTM D2265, °F. | 521 |
| Oil Separation, SDM-433, % | |
| 212° F., 6 hr. | 2.5 |
| 212° F., 24 hr. | 4.9 |
| 300° F., 24 hr. | 3.8 |
| 350° F., 24 hr. | 5.6 |
| Four Ball Wear, ASTM D2266 at | 0.44 |

-continued

| | |
|---|---|
| 40 kg, 1200 rpm for 1 hr | |
| Four Ball EP, ASTM D2596 | |
| last nonseizure load, kg | 80 |
| weld load, kg | 620 |
| load wear index | 85.5 |
| Optimol SRV Stepload Test, 80° C., maximum passing load, Newtons | 1,000 |
| Optimol SRV Stepload Test, 150° C. maximum passing load, Newtons | 1,000 |
| Fretting Wear, ASTM D4170, 24 hr mg loss/race set | 0.0 |
| Copper Strip Corrosion, ASTM D4048 300° F., 24 hr | 1A |
| Steel Strip Corrosion, 300° F., 24 hr. | No Change |
| Elastomer Compatibility with Polyester | |
| % loss tensile strength | 18.7 |
| % loss maximum elongation | 5.04 |
| Elastomer Compatibility with Silicone | |
| % loss tensile strength | 6.80 |
| % loss maximum elongation | 11.3 |

EXAMPLE 40

A calcium complex base grease was prepared in a laboratory grease kettle as follows: 1,058.06 grams of calcium hydroxide was slurried in 17.5 pounds of a hydrofinished, solvent extracted, 850 SUS, paraffinic mineral oil at about 140° F. The temperature was then increased to 170° F. and 666.20 grams of 12-hydroxystearic acid and 1,968.42 grams of hydrogenated fatty acids were added. The temperature was kept at about 170° F. during the reaction. After the reaction appeared over, 1,121.19 grams of glacial acetic acid was added and mixed for thirty minutes. Then 6.75 pounds of the same 850 SUS oil was slowly added to the kettle and the contents were heated to 300° F. while continuing to stir. When the grease appeared dry, the kettle was closed and the contents were heated under vacuum for 30 minutes. The vacuum was then released, the kettle was opened, and the contents were heated to 390° F. while applying a blanket of nitrogen. Stirring was maintained throughout this procedure. After the grease reached 390° F., it was cooled to 250° F. and 3.63 pounds of the same 850 SUS oil was slowly added. After heating and stirring the grease under a vacuum pressure for 30 minutes, the calcium complex base grease was removed and stored in a container for later use.

EXAMPLE 41

This grease served as the control for subsequent tests involving calcium complex thickened greases. A 11.54 gram quantity of the base oil used in Example 20 was added to 150 grams of the base calcium complex grease of Example 40. The mixture was milled in a roll mill until a homogeneous grease was obtained. This grease which contained no additives was then subjected to a Four Ball EP test. The results were as follows:

| | |
|---|---|
| Last nonseizure load, kg | 100 |
| Weld load, kg | 200 |
| Load wear index | 42 |

EXAMPLE 42

A calcium complex thickened front-wheel drive grease was prepared similar to the manner of Example 41, except that 4% by weight calcium sulfate was added to the base grease. The Four Ball EP showed improvements in EP/antiwear properties as measured by the weld load.

| | |
|---|---|
| Last nonseizure load, kg | 63 |
| Weld load, kg | 315 |
| Load wear index | 39.8 |

EXAMPLE 43

A calcium complex thickened front-wheel drive grease was prepared similar to the manner of Example 42, except that 10% by weight of calcium sulfate was added to the grease. Four Ball EP test results showed further improvement over the calcium complex base grease of Example 41.

| | |
|---|---|
| Last nonseizure load, kg | 40 |
| Weld load, kg | 620 |
| Load wear index | 68.5 |

EXAMPLE 44

A calcium complex thickened front-wheel drive grease was prepared similar to the manner of Example 43, except that 4% by weight of finely divided, precipitated calcium carbonate was added to the grease instead of calcium sulfate. The mean particle diameter of the calcium carbonate was less than 2 microns. Four Ball EP test results showed improvement over the calcium complex base grease of Example 41.

| | |
|---|---|
| Last nonseizure load, kg | 80 |
| Weld load, kg | 250 |
| Load wear index | 40.1 |

EXAMPLE 45

A calcium complex thickened front-wheel drive grease was prepared similar to the manner of Example 44, except that 10% by weight of finely divided, precipitated calcium carbonate was added to the grease. The mean particle diameter of the calcium carbonate was less than 2 microns. Four Ball EP test results showed improvement over the calcium complex base grease of Example 41.

| | |
|---|---|
| Last nonseizure load, kg | 100 |
| Weld load, kg | 400 |
| Load wear index | 62.3 |

EXAMPLE 46

A calcium complex thickened front-wheel drive grease was prepared similar to the manner of Example 45, except that 2% by weight of calcium sulfate and 2% by weight of calcium carbonate were added to the base grease. The Four Ball EP test results showed that this grease with a total additive level of 4% was superior to the calcium sulfate grease (without calcium carbonate) of Example 42 and the calcium carbonate grease (without calcium sulfate) of Example 44, even though the total levels of additives in the two greases of Examples 42 and 44 were also 4%. Therefore, the combination of calcium sulfate and calcium carbonate at a given total level gave results superior to that of either additive alone at the same level. This result is surprising and unexpected and was not anticipated or obvious from prior art greases.

| | |
|---|---|
| Last nonseizure load, kg | 80 |
| Weld load, kg | 315 |
| Load wear index | 43.6 |

EXAMPLE 47

Another calcium complex base grease was prepared in a manner similar to that of Example 40. A portion of the base grease was removed from the grease kettle and stored for use in Example 48. To the remaining base grease, additives and base oil were added. The corrosion inhibitor chosen was Nasul 729 by R. T. Vanderbilt Co. The resulting grease was milled using a Gaulin Homogenizer at 7,000 psi. A smooth product resulted with the following composition:

| Component | % (wt) |
|---|---|
| 850 SUS Oil | 43.67 |
| 350 SUS Oil | 29.12 |
| Calcium Complex Thickener | 15.00 |
| Calcium Sulfate | 5.00 |
| Calcium Carbonate | 5.00 |
| Nasul 729 | 1.50 |
| Vanlube 848 | 0.50 |
| Excess Calcium Hydroxide | 0.21 |

The excess calcium hydroxide in the final grease was that amount present from the calcium complex base grease. This amount was purposely included to help insure a complete thickener-forming reaction.

The grease was tested and had the following performance properties:

| | |
|---|---|
| Worked Penetration, ASTM D217 | 354 |
| Dropping Point, °F., ASTM D2265 | 546 |
| Oil Separation, %, SDM 433 | |
| 6 hr, 212° F. | 1.7 |
| 24 hr, 212° F. | 4.0 |
| 24 hr, 300° F. | 5.8 |
| 24 hr, 350° F. | 4.4 |
| Four Ball Wear, mm, ASTM D2266 at 40 kg, 1,200 rpm, 167° F., 1 hour | 0.50 |
| Four Ball EP, ASTM D2596 | |
| last nonseizure load, kg | 63 |
| weld load, kg | 620 |
| load wear index | 64.8 |
| Fretting Wear, ASTM D4170, 24 hr mg loss/race set | 0.2 |
| Optimol SRV Stepload Test, 80° C. | 700 |
| Copper Strip Corrosion, ASTM D4048 | |

As can be seen above, the test results for the calcium complex soap grease of Example 47 are excellent.

EXAMPLE 48

A polyurea and calcium complex thickened front-wheel drive grease was prepared in a manner similar to that of Example 47, using the unused portion of the Example 47 calcium complex base grease. This time, however, before any additives or base oil were added, polyurea thickened base grease was added to the calcium complex base grease in the grease kettle. The amount of polyurea thickened base grease added was sufficient to give a new base grease with equal weights of calcium complex and polyurea thickener. The new polyurea and calcium complex base grease was then finished with additives and additional base oil as indicated below, and then milled in a manner similar to Example 47. A smooth product resulted with the following composition:

| Component | % (wt) |
|---|---|
| 850 SUS Oil | 48.42 |
| 350 SUS Oil | 32.28 |
| Calcium Complex Thickener | 7.00 |
| Polyurea Thickener | 7.00 |
| Calcium Sulfate | 2.00 |
| Calcium Carbonate | 2.00 |
| Nasul 729 | 1.00 |
| Vanlube 848 | 0.20 |
| Excess Calcium Hydroxide | 0.10 |

The polyurea and calcium complex thickened grease was tested and had the following performance properties:

| | |
|---|---|
| Worked Penetration, ASTM D217 | 315 |
| Dropping Point, °F., ASTM D2265 | 527+ |
| Oil Separation, %, SDM 433 | |
| 24 hr, 212° F. | 2.4 |
| 24 hr, 300° F. | 5.5 |
| 24 hr, 350° F. | 7.6 |
| Four Ball Wear, mm, ASTM D2266 at 40 kg, 1,200 rpm, 167° F., 1 hour | 0.45 |
| Four Ball EP, ASTM D2596 | |
| last nonseizure load, kg | 63 |
| weld load, kg | 400 |
| load wear index | 46.4 |
| Fretting Wear, ASTM D4170, 24 hr mg loss/race set | 1.6 |
| Optimol SRV Stepload Test, 80° C. | 1,000 |
| Copper Strip Corrosion, ASTM D4048 300° F., 24 hr | 1A |
| Elastomer Compatibility with Polyester | |
| % loss tensile strength | 9.65 |
| % loss maximum elongation | 2.20 |
| Elastomer Compatibility with Silicone | |
| % loss tensile strength | 14.0 |
| % loss maximum elongation | 19.0 |

The test results for the polyurea and calcium complex soap thickened grease of Example 48 are excellent.

EXAMPLE 49

Example 48 was a grease thickened by a thickener system comprising polyurea and calcium complex soap. This multi-component thickener system was made by separately making a polyurea base grease and a calcium complex base grease and then admixing portions of the two base greases. Such a separate procedure is not always necessary. An equally acceptable alternative is to make the polyurea base grease and then form the calcium complex thickener in the polyurea base grease. By using such a procedure one avoids the necessity of either storing one base grease for later addition to the other base grease or using two grease kettles simultaneously. The trade-off is in the time requirements. When manufacturing a grease similar in composition and method to Example 48, both bases can be made simultaneously in separate kettles and then one can be transferred into the kettle of the other for finishing. Alternatively, one base grease can be made, stored in an appropriate vessel, and then transferred to the other base grease after it is made. However, both of these procedures requires at least two containers or vessels to be in simultaneous use. If the multi-component base grease is made by forming the polyurea base grease and then forming the calcium complex base grease in the polyurea base grease, then only one container (kettle) is required. However, such a procedure will require more time.

A polyurea and calcium complex thickened grease similar to Example 48 was prepared as follows. A polyurea base grease similar to that of Example 1 was prepared. Additional 850 SUS oil was added to bring the polyurea thickener level to 18.0%. The polyurea base grease, 28.66 pounds in amount, was cooled to 170° F. and to it was added 800.00 grams of calcium hydroxide. After sufficient stirring to provide a smooth mixture (about 15 minutes), 363.68 grams of 12-hydroxystearic acid and 1,074.57 grams of hydrogenated fatty acids were added and the resulting mixture was stirred for 45 minutes at about 175° F. After the reaction appeared over, 612.06 grams of glacial acetic acid was added and mixed for 30 minutes. The grease was then heated to 310° F. until all water from the reaction had volatilized and the grease was dry. The kettle was then closed and the grease was heated and stirred under vacuum for one hour. Then the kettle was opened and an additional 428.58 grams of 850 SUS oil and 16.3 pounds of 350 SUS oil were slowly added to the base grease while continuing to stir. When the base grease was well mixed and smooth, it was cooled to 200° F. A portion was removed from the kettle for later use. To the remaining base grease was added additional oil and additives as indicated below. The resulting finished grease was milled in a manner similar to that of Example 48. A smooth product resulted with the following composition.

| Component | % (wt) |
|---|---|
| 850 SUS Oil | 55.30 |
| 350 SUS Oil | 18.00 |
| Calcium Complex Thickener | 7.00 |
| Polyurea Thickener | 7.00 |
| Calcium Sulfate | 5.00 |
| Calcium Carbonate | 5.00 |
| Nasul 729 | 1.50 |
| Vanlube 848 | 0.50 |
| Excess Calcium Hydroxide | 0.70 |

The polyurea and calcium complex thickened grease was tested and had the following performance properties:

| | |
|---|---|
| Worked Penetration, ASTM D217 | 309 |
| Dropping Point, °F., ASTM D2265 | 542+ |
| Oil Separation, %, SDM 433 | |
| 24 hr, 212° F. | 1.7 |
| 24 hr, 300° F. | 2.6 |
| 24 hr, 350° F. | 8.2 |
| Four Ball Wear, mm, ASTM D2266 at 40 kg, 1,200 rpm, 167° F., 1 hour | 0.40 |
| Four Ball EP, ASTM D2596 | |
| last nonseizure load, kg | 80 |
| weld load, kg | 800 |
| load wear index | 86.2 |
| Fretting Wear, ASTM D4170, 24 hr mg loss/race set | 1.3 |
| Optimol SRV Stepload Test, 80° C. | 1,200 |
| Copper Strip Corrosion, ASTM D4048 300° F., 24 hr | 1A |
| Elastomer Compatibility with Polyester | |
| % loss tensile strength | 23.9 |
| % loss maximum elongation | 9.39 |
| Elastomer Compatibility with Silicone | |
| % loss tensile strength | 32.5 |

-continued

| | |
|---|---|
| % loss maximum elongation | 31.7 |

EXAMPLE 50

To further illustrate the utility of a calcium sulfate and calcium carbonate system, a grease similar to that of Example 47 was made except a calcium complex base grease was not used. Instead a simple calcium 12-hydroxystearate base grease was used. This simple calcium 12-hydroxystearate grease was formulated using a similar procedure as was generally described earlier. Additives and oil were added to the base grease and the resulting grease was milled using a Gaulin Homogenizer at 7,000 psi. A smooth grease was obtained with the following composition:

| Component | % (wt) |
|---|---|
| 850 SUS Oil | 52.97 |
| 350 SUS Oil | 27.70 |
| Calcium 12-Hydroxystearate Thickener | 8.00 |
| Calcium Sulfate | 4.72 |
| Calcium Carbonate | 4.72 |
| Nasul 729 | 1.42 |
| Vanlube 848 | 0.47 |
| Excess Calcium Hydroxide | Nil |

The simple calcium soap thickened grease was tested and had the following performance properties:

| | |
|---|---|
| Work Penetration, ASTM D217 | 318 |
| Dropping Point, °F., ASTM D2265 | 373 |
| Oil Separation, %, SDM 433 | |
| 6 hr, 212° F. | 1.2 |
| 24 hr, 212° F. | 2.8 |
| 24 hr, 300° F. | 11.3 |
| Four Ball Wear, mm, ASTM D2266 at 40 kg, 1,200 rpm, 167° F., 1 hour | 0.42 |
| Four Ball EP, ASTM D2596 | |
| last nonseizure load, kg | 63 |
| weld load, kg | 620 |
| load wear index | 59.7 |
| Fretting Wear, ASTM D4170, 24 hr mg loss/race set | 0 |
| Optimol SRV Stepload Test, 80° C. | 400 |
| Elastomer Compatibility with Polyester | |
| % loss tensile strength | 14.6 |
| % loss maximum elongation | 7.27 |

The test results for the simple calcium soap thickened grease of Example 50 are very good, although the dropping point is not as high as that of Examples 37, 38, 39, 47, 48, and 49.

EXAMPLE 51

To further illustrate the utility of a calcium sulfate and calcium carbonate system, a simple calcium soap thickened grease similar to that of Example 50 was made except that an additional minor amount of calcium hydroxide was also added. Final grease comosition was as follows:

| Component | % (wt) |
|---|---|
| 850 SUS Oil | 52.70 |
| 350 SUS Oil | 27.56 |
| Calcium 12-Hydroxystearate Thickener | 7.96 |
| Calcium Sulfate | 4.70 |
| Calcium Carbonate | 4.70 |
| Nasul 729 | 1.41 |

-continued

| Component | % (wt) |
|---|---|
| Vanlube 848 | 0.47 |
| Excess Calcium Hydroxide | 0.50 |

The simple calcium soap thickened grease was tested and had the following performance properties:

| | |
|---|---|
| Work Penetration, ASTM D217 | 326 |
| Dropping Point, °F., ASTM D2265 | 333 |
| Oil Separation, %, SDM 433 | |
| 6 hr, 212° F. | 1.4 |
| 24 hr, 212° F. | 2.5 |
| 24 hr, 300° F. | 11.9 |
| Four Ball Wear, mm, ASTM D2266 at 40 kg, 1,200 rpm, 167° F., 1 hour | 0.44 |
| Four Ball EP, ASTM D2596 | |
| last nonseizure load, kg | 80 |
| weld load, kg | 620 |
| load wear index | 64.2 |
| Fretting Wear, ASTM D4170, 24 hr mg loss/race set | 0 |
| Optimol SRV Stepload Test, 80° C. | 700 |
| Elastomer Compatibility with Polyester | |
| % loss tensile strength | 13.5 |
| % loss maximum elongation | 4.55 |

By comparing the Four Ball EP, Four Ball Wear, and SRV Stepload test results of Examples 50 and 51, the beneficial effect of a minor amount of excess calcium hydroxide is again seen.

EXAMPLE 52

A grease was made using a multi-component thickener system comprising polyurea and calcium 12-hydroxystearate in which the calcium sulfate and calcium carbonate additive system was used. A portion of the base calcium 12-hydroxystearate base grease prepared in Example 50 was added to a portion of a polyurea base grease similar to that prepared in Example 1. The relative amounts of each base grease were such that the final mixed base grease had equal weights of both polyurea and calcium 12-hydroxystearate. To this base grease was added additional oil and additives as indicated below. The resulting finished grease was milled in a manner similar to that of Example 51. A smooth product resulted with the following composition.

| Component | % (wt) |
|---|---|
| 850 SUS Oil | 46.52 |
| 350 SUS Oil | 30.98 |
| Calcium 12-Hydoxystearate | 4.75 |
| Polyurea | 4.75 |
| Calcium Sulfate | 5.00 |
| Calcium Carbonate | 5.00 |
| Nasul BSN | 1.50 |
| Vanlube 848 | 0.50 |
| Excess Calcium Hydroxide | 1.00 |

The grease was tested and had the following performance properties:

| | |
|---|---|
| Worked Penetration, ASTM D217 | 327 |
| Dropping Point, °F., ASTM D2265 | 487 |
| Oil Separation, %, SDM 433 | |
| 6 hr, 212° F. | 0.8 |
| 24 hr, 212° F. | 2.6 |
| 24 hr, 300° F. | 5.8 |
| Four Ball Wear, mm, ASTM D2266 at 40 kg, 1,200 rpm, 167° F., 1 hour | 0.42 |
| Four Ball EP, ASTM D2596 | |
| last nonseizure load, kg | 63 |
| weld load, kg | 800 |
| load wear index | 78.1 |
| Fretting Wear, ASTM D4170, 24 hr mg loss/race set | 0 |
| Optimol SRV Stepload Test, 80° C. | 600 |
| Copper Strip Corrosion, ASTM D4048 300° F., 24 hr | 1A |
| Elastomer Compatibility with Polyester | |
| % loss tensile strength | 15.4 |
| % loss maximum elongation | 4.67 |
| Elastomer Compatibility with Silicone | |
| % loss tensile strength | 8.18 |
| % loss maximum elongation | 17.0 |

The test results for the polyurea/calcium 12-hydroxystearate grease of Example 52 are very good. The dropping point is much improved over that of Examples 50 and 51.

Among the many advantages of the novel lubricating grease are:

1. High performance on front-wheel drive joints.
2. Superior fretting wear protection.
3. Excellent oil separation qualities, even at high temperatures.
4. Remarkable compatibility and protection of elastomers and seals of front-wheel drive joints.
5. Greater stability at high temperatures for long periods of time.
6. Superior oil separation properties over a wide temperature range.
7. Excellent performance over a wide temperature range.
8. Simpler to manufacture.
9. Easier to pump.
10. Less tacky.
11. Good shear stability and oil separation properties.
12. Safe.
13. Economical.
14. Effective.

Although embodiments of this invention have been described, it is to be understood that various modifications and substitutions can be made by those skilled in the art without departing from the novel spirit and scope of this invention.

What is claimed is:

1. A lubricating grease, comprising:
a thickener;
a base oil;
a sufficient amount of an additive package to impart extreme pressure and wear resistant properties to said lubricating grease, said additive package comprising a sulfate and a carbonate in the absence of halogenated compounds.

2. A lubricating grease in accordance with claim 1 wherein said carbonate comprises a compound selected from the group consisting of a Group 2a alkaline earth metal and a Group 1a alkali metal.

3. A lubricating grease in accordance with claim 1 wherein said sulfate comprises a compound selected from the group consisting of a Group 2a alkaline earth metal and a Group 1a alkali metal.

4. A lubricating grease in accordance with claim 1 including a boron-containing oil separation inhibitor comprising a member selected from the group consisting of a borated amine, a borate of a Group 1a alkali metal, a borate of a Group 2a alkaline earth metal, a borate of a transition metal, and boric oxide.

5. A lubricating grease in accordance with claim 1 wherein said sulfate and carbonate are present in the absence of oil soluble sulfur-containing compounds.

6. A lubricating grease in accordance with claim 1 wherein said sulfate and carbonate are present in the abence of insoluble arylene sulfide polymers.

7. A lubricating grease in accordance with claim 1 wherein said additive package comprises calcium hydroxide.

8. A lubricating grease, comprising by weight:
from about 45% to about 85% base oil;
from about 3% to about 15% thickener comprising a member selected from the group consisting of biurea, triurea, polyurea, simple calcium soap, calcium complex soap, and combinations thereof; and
from about 4% to about 52% additive package for imparting substantial extreme pressure and anti-wear properties to said lubricating grease in the absence of halogenated compounds, said additive package comprising a carbonate of a Group 1a alkali metal or a Group 2a alkaline earth metal and a sulfate of a Group 1a alkali metal or a Group 2a alkaline earth metal.

9. A lubricating grease in accordance with claim 8 wherein said grease comprises by weight:
at least 70% base oil;
from about 7% to about 12% of said thickener; and
from about 4% to about 22% of said additives.

10. A lubricating grease in accordance with claim 8 wherein:
said alkaline earth metal is selected from the group consisting of beryllium, magnesium, calcium, strontium, and barium; and
said alkali metal is selected from the group consisting of lithium, sodium, and potassium.

11. A lubricating grease in accordance with claim 8 wherein said carbonate and said sulfate are each present in an amount ranging from about 0.1% to about 20% by weight of said grease.

12. A lubricating grease in accordance with claim 11 including a boron-containing oil separation material present in an amount ranging from about 0.01% to about 10% by weight of said grease.

13. A lubricating grease in accordance with claim 12 wherein:
said carbonate and said sulfate are each present in an amount ranging from about 2% to about 10% by weight of said grease; and
said boron-containing oil separation material is present in amount ranging from about 0.1% to about 5% by weight of said grease.

14. A lubricating grease in accordance with claim 13 wherein:
said carbonate comprises calcium carbonate;
said sulfate comprises calcium sulfate; and
said boron-containing oil separation material comprises a borated compound selected from the group consisting of borated amine and potassium triborate.

15. A lubricating grease, comprising:
from about 45% to about 85% by weight base oil;
from about 3% to about 15% by weight thickener comprising polyurea;
from about 4% to about 52% by weight of extreme pressure wear-resistant additives comprising calcium sulfate and calcium carbonate, said calcium sulfate being present in an amount ranging from about 0.1% to about 20% by weight of said grease and said calcium carbonate being present in an amount ranging from about 0.1% to about 20% by weight of said grease.

16. A lubricating grease in accordance with claim 15 including from about 0.01% to about 10% of a boron-containing oil-separation inhibitor selected from the group consisting of borated amine and potassium triborate.

17. A lubricating grease in accordance with claim 16 wherein said grease comprises:
at least 70% by weight of said base oil;
from about 7% to about 12% by weight of said polyurea thickener;
from about 4% to about 25% by weight of said additive, said calcium carbonate being present in an amount ranging from about 2% to about 10% by weight of said grease, and said calcium sulfate being present in an amount ranging from about 2% to about 10% by weight of said grease; and
from about 0.25% to about 2.5% by weight of said boron-containing oil-separation inhibitor.

18. A lubricating grease in accordance with claim 15 wherein said base oil comprises at least one member selected from the group consisting of naphthenic oil, paraffinic oil, aromatic oil, solvent-extracted hydrogenated dewaxed base oil, and a synthetic oil, said synthetic oil comprising a member selected from the group consisting of a polyalphaolefin, a polyester, a diester, and a silicone-containing oil.

19. A lubricating grease in accordance with claim 15 wherein said thickener comprises said polyurea and a calcium soap selected from the group consisting of simple calcium soap and calcium complex soap.

20. A lubricating grease in accordance with claim 15 including from about 0.01% to about 5% by weight calcium hydroxide.

21. A lubricating grease in accordance with claim 20 wherein said calcium hydroxide is present in the amount of about 0.1% to about 2% by weight of said grease.

* * * * *

UNITED STATES PATENT AND TRADEMARK OFFICE

CERTIFICATE OF CORRECTION

PATENT NO. : 4,986,923
DATED : January 22, 1991
INVENTOR(S) : John A. Waynick

It is certified that error appears in the above-indentified patent and that said Letters Patent is hereby corrected as shown below:

Column 12, line 24 "chained Esters" should read --chained. Esters--
Column 16, line 68 "grease The" should read --grease. The--
Column 29, line 53 Remainder of table missing. Insert the following:

| | |
|---|---|
| 300 F, 24 hr. | 1A |
| Elastomer Compatibility with Polyester % loss tensile strength | 11.7 |
| % loss maximum elongation | 4.46 |

Column 54, line 5 Remainder of table missing. Insert the following:
Elastomer Compatibility with silicone

| | |
|---|---|
| % loss tensile strength | 7.95 |
| % loss maximum elongation | 16.9 |

Signed and Sealed this

Fifteenth Day of June, 1993

*Attest:*

*Attesting Officer*

Michael K. Kirk

MICHAEL K. KIRK

*Acting Commissioner of Patents and Trademarks*

UNITED STATES PATENT OFFICE

CERTIFICATE OF CORRECTION

Patent No. 4,986,923 Dated January 22, 1991

Inventor(s) John A. Waynick

It is certified that error appears in the above-identified patent and that said Letters Patent is hereby corrected as shown below:

| Col. | Line | |
|---|---|---|
| 11 | 19 | "loose" should read --lose-- |
| 12 | 24 | "chained Esters" should read --chained. Esters-- |
| 13 | 58 | "carbonate Advantageously" should read --carbonate. Advantageously-- |
| 16 | 68 | "grease The" should read --grease. The-- |
| 29 | 53 | Remainder of table missing. Please insert the following: |

| | |
|---|---|
| 300°F, 24 hr. | 1A |
| Elastomer Compatibility with Polyester | |
| % loss tensile strength | 11.7 |
| % loss maximum elongation | 4.46 |

Signed and Sealed this

Seventh Day of September, 1993

Bruce Lehman

*Attest:*

BRUCE LEHMAN

*Attesting Officer*

*Commissioner of Patents and Trademarks*

UNITED STATES PATENT OFFICE
CERTIFICATE OF CORRECTION

Patent No. 4,986,923 Dated January 22, 1991

Inventor(s) John A. Waynick

It is certified that error appears in the above-identified patent and that said Letters Patent is hereby corrected as shown below:

| Col. | Line | | |
|---|---|---|---|
| | | Elastomer Compatibility with Silicone | |
| | | % loss tensile strength | 7.95 |
| | | % loss maximum elongation | 16.9 |
| 32 | 59-60 | "comosition" should read --composition-- | |
| 35 | 8 | "abence" should read --absence-- | |